United States Patent [19]

Faktus et al.

[11] Patent Number: 4,710,063

[45] Date of Patent: Dec. 1, 1987

[54] NON-RETURN VALVE FOR BORE HOLE SLEEVES

[75] Inventors: Eskil Faktus, Arjang; Rolf Dahlen, Tocksfors, both of Sweden

[73] Assignee: Elektro Mekani Arjang AB, Arjang, Sweden

[21] Appl. No.: 893,327

[22] PCT Filed: Nov. 25, 1985

[86] PCT No.: PCT/SE85/00481

§ 371 Date: Jul. 25, 1986

§ 102(e) Date: Jul. 25, 1986

[87] PCT Pub. No.: WO86/03254

PCT Pub. Date: Jun. 5, 1986

[30] Foreign Application Priority Data

Nov. 28, 1984 [SE] Sweden ..... 8406010

[51] Int. Cl.[4] ..... E21D 21/00

[52] U.S. Cl. ..... 405/269; 137/847; 166/151

[58] Field of Search ..... 405/269, 260; 166/118, 166/122, 141, 142, 147, 149, 151; 137/847

[56] References Cited

U.S. PATENT DOCUMENTS

| | | | |
|---|---|---|---|
| 141,587 | 8/1873 | Painter | 137/847 |
| 2,446,571 | 8/1948 | Browne | 137/847 |
| 2,603,293 | 7/1952 | Lynes | 166/147 X |
| 2,850,102 | 9/1958 | Brown | 137/847 X |
| 3,035,639 | 5/1962 | Brown et al. | 166/151 X |
| 3,259,192 | 7/1966 | Hyde | 166/151 X |
| 3,387,624 | 6/1968 | Soucy | 137/847 |
| 3,422,844 | 1/1969 | Grise | 137/847 |
| 4,260,295 | 4/1981 | Yestlund | 405/269 |
| 4,607,663 | 8/1986 | Raftis et al. | 137/847 X |

FOREIGN PATENT DOCUMENTS 2402509 7/1975 Fed. Rep. of Germany .

*Primary Examiner*—Dennis L. Taylor
*Attorney, Agent, or Firm*—Spencer & Frank

[57] ABSTRACT

A non-return valve for bore hole sleeves, which are intended for injection of a sealing and/or reinforcing compound into rock cracks and similar cracks and which comprise a rigid case (10), one end (10A) of which is provided with means for detachable connection to the case of a pump hose (12) for the compound to be injected, as well as an expandable device (15) for securing the rigid case in the bore hole (21), comprises an elastic sleeve (22) which is adapted at the other end (10B) of the rigid case (10) in such a way that the rigid case (10) runs into the elastic sleeve (22). The elastic sleeve is adapted for automatical contraction, when no compound is being injected through the elastic sleeve, so that already injected compound can not flow backwards into the rigid case (10). The sleeve (22) is preferably provided with diametrically positioned clamp means (23–26) at its free ends, so that the free end of the sleeve has a flat shape, when no compound is being injected through the elastic sleeve. When compound is to be injected through the elastic sleeve, the sleeve is expanded by the pressure of the compound, so that the flow area of the elastic sleeve is increased. When the injection pressure ceases, the sleeve is contracted. The pressure outside the sleeve conduces to the contraction of the sleeve, so that no injected compound can be forced backwards through the elastic sleeve.

13 Claims, 2 Drawing Figures

NON-RETURN VALVE FOR BORE HOLE SLEEVES

BACKGROUND OF THE INVENTION

The present invention relates to a non-return valve for bore hole sleeves which are intended for injection of a sealing and/or reinforcing compound into rock cracks and similar cracks and which comprise a rigid case, one end of which is provided with means for detachable connection to the case of a pump hose for the compound to be injected, as well as an expandable device for securing the rigid case in the bore hole.

When bore hole sleeves are used, said sleeves are first fixed by means of the expandable device in holes that have been bored in the rock. The sealing and/or reinforcing compound is then injected through the bore hole sleeves into the rock crack. The bore hole sleeves have to be provided with a non-return valve of some type to prevent the compound from flowing back through the bore hole sleeves, when the pump pressure ceases.

The non-return valves which hitherto have been used in connection with bore hole sleeves have comprised a movable mechanical valve means, for example a ball, as disclosed in the German Patent Application No. 2 402 509. A non-return valve of this type has two disadvantages. Firstly, it is difficult to achieve a reliable operation of the valve means during the heavy working conditions prevailing during injection of, for example, cement grout or a similar sealing compound under high pressure into rock cracks. Secondly, the valve element obstructs the injection of the compound due to the fact that the flow area of the bore hole sleeve is reduced. It is particularly difficult to use a ball valve as non-return valve in connection with a bore hole sleve of the type disclosed in the Swedish Patent Application No. 8204256-5, where a blocking means is provided at the exit end of the bore hole sleeve to enable the establishment of an initial pressure in the bore hole sleeve to actuate the expandable means. The blocking means is then forced out of the bore hole sleeve by further increasing the pressure in the bore hole sleeve. Furthermore, non-return valves comprising balls or other movable valve means and corresponding valve seats are expensive to manufacture.

SUMMARY OF THE INVENTION

The main object of the invention is to provide a non-return valve which does not have the above mentioned disadvantages. According to the invention, this is achieved by giving the non-return valve the features set forth in the claims.

Due to the fact that the non-return valve is an elastic sleeve into which the rigid case of the bore hole sleeve runs and which is adapted for automatical contraction, when no compound is being injected, a reliable valve operation is achieved and a flow area for the injected compound in the non-return valve is provided which has substantially the same size as the flow area in the rigid case of the bore hole sleeve, so that the non-return valve does not obstruct the injection of the compound into a rock crack. Due to the fact that the elastic sleeve is expanded and contracted, no movable valve means with valve seats are required, thus increasing the reliability of the operation of the non-return valve and substantially reducing the manufacturing cost of the non-return valve. Particularly by providing contraction means at the free end of the elastic sleeve in such a way that they cause a flattening of the exit end of the elastic sleeve, a very reliable valve operation is achieved, because the backward flow of the compound conduces to the compression of the mouth of the elastic sleeve.

BRIEF DESCRIPTION OF THE DRAWINGS

One embodiment of a non-return valve according to the invention will now be further described below with reference to the accompanying drawings.

DESCRIPTION OF THE PREFERRED EMBODIMENT

Figure 1:
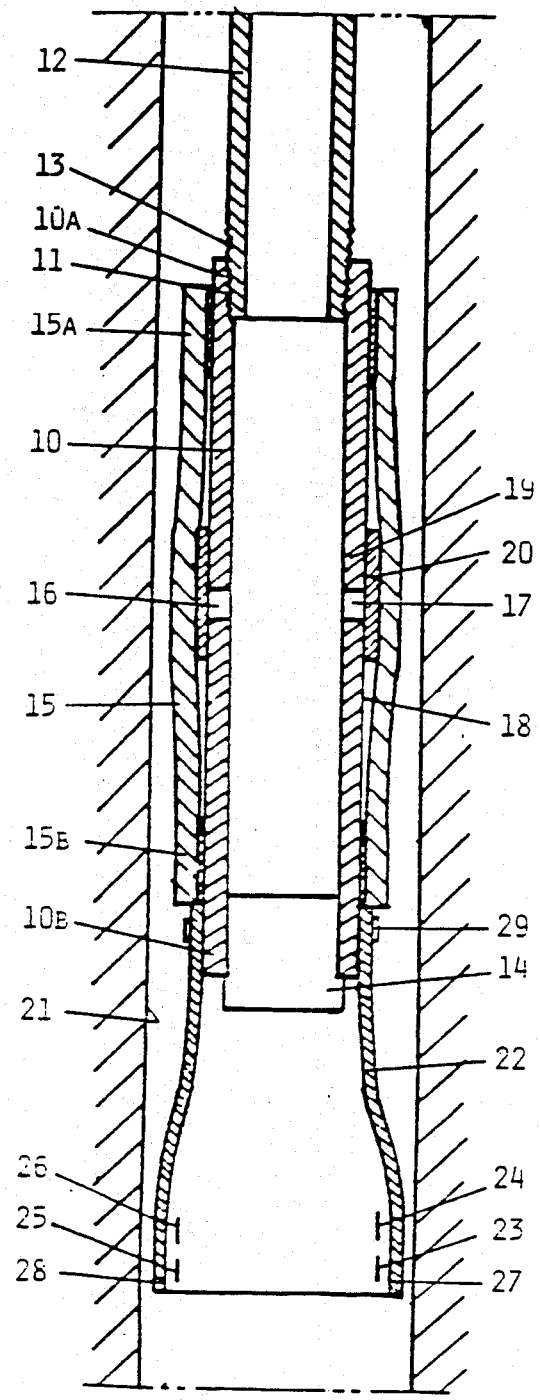
FIG. 1 is a longitudinal section of a bore hole sleeve which is inserted into a bore hole and which has a non-return valve according to the invention and an expandable device.
Figure 2:
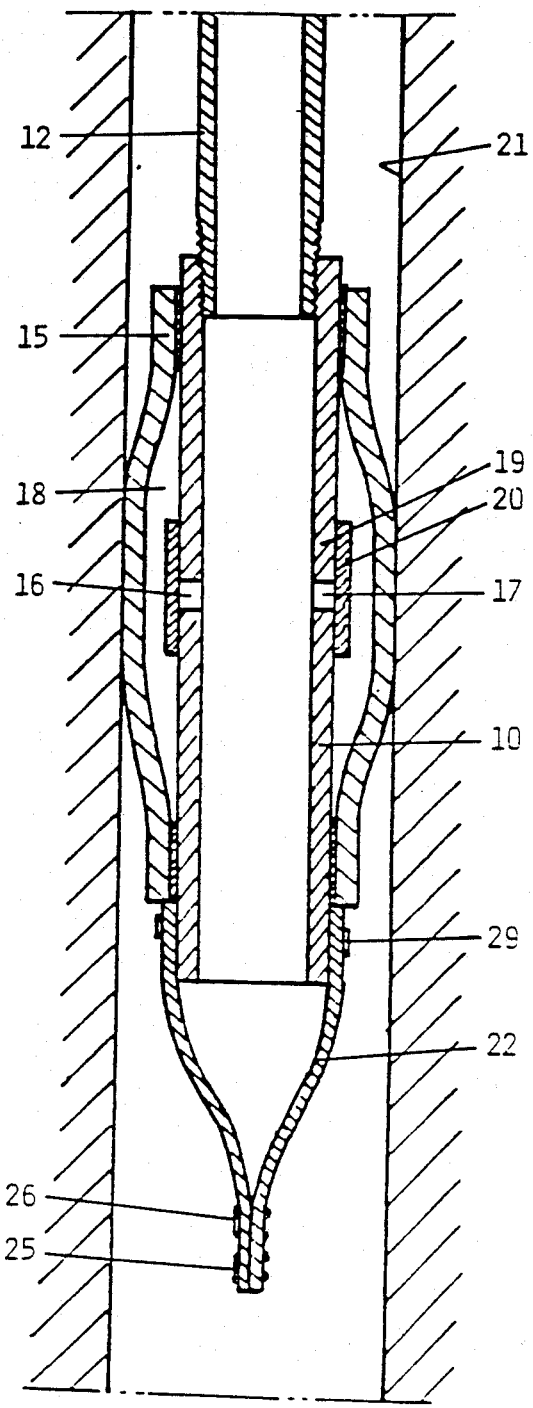
FIG. 2 is a longitudinal section of the bore hole sleeve shown in FIG. 1, the section being rotated 90° in relation to the section of FIG. 1 and the sleeve being fixed in the bore hole by means of the expandable device.

The bore hole sleeve shown in FIGS. 1 and 2 comprises a rigid case 10, preferably of metal, for example aluminium. The case is at one end 10A provided with internal threads 11 for connection to a pump hose 12 provided with external threads 13. At the opposite end 10B of the case a blocking means in the shape of a plug 14 is inserted in such a way that the plug loosens and is pushed out of the case 10, when the pressure in the case exceeds a certain predetermined value. An elastic rubber sleeve 15 surrounding the rigid case 10 is provided on the outside of the case 10. The ends 15A and 15B of the rubber sleeve are attached to the rigid case 10, for example by vulcanization. Two openings 16,17 are provided in the wall of the rigid case 10, so that the inside of the rigid case is connected to the space 18 between the rigid case 10 and the surrounding rubber sleeve 15. A non-return valve 19,20 is provided at both these openings. This non-return valve consists of a rubber membrane 20 attached to the outer wall of the rigid case in such a way that the membrane at least at one point can be lifted up from the wall of the rigid case and form a channel connection for a pressurized compound from the inside of the rigid case to the space 18 between the rigid case 10 and the rubber sleeve 15. The lifting occurs, when the pressure in the rigid case exceeds a certain value. Pressurized compound can then be introduced from the inside of the rigid case to the space between the sleeve 15 and the case 10, so that the rubber sleeve is forced to expand and to abut against the wall 21 of the bore hole. When the pressure in the rigid case is reduced, the introduced compound can not return to the rigid case, because the membrane then closes the opening in the wall of the rigid case. Thus, the membrane will operate as a non-return valve. The non-return valve is so designed that it allows introduction of pressurized compound in the space between the rigid case and the rubber sleeve at a pressure level which is below the pressure level at which the plug 14 is pushed out of the rigid case.

An elastic sleeve 22 is attached to the exit end 10B of the rigid case in such a way that the rigid case runs into the elastic sleeve. The elastic sleeve is at its free end provided with clip means 23,24 and 25,26 which give the elastic sleeve a flattened shape at the free end, i. e. at the exit opening of the sleeve. These clip means are in the disclosed embodiment staples which are forced through the wall of the sleeve and pass through the wall two times, so that two projecting folds 27,28 are formed on the wall of the elastic sleeve. Two staples 23,24 and 25,26 are provided on either side of the elastic sleeve diametrically in relation to the central axis of the elastic sleeve 22, so that the two folds 27,28 are diametrically positioned at the exit end of the sleeve. The folds give the exit end of the sleeve a flattened shape, so that the exit opening has the shape of a narrow slot in the rest position of the sleeve. The staples 23,24 and 25,26 are so positioned that each staple has its longitudinal direction in parallel with the longitudinal axis of the elastic sleeve, so that the folds 27,28 are as low as possible.

The elastic sleeve 22 can be attached to the exit end 10B of the rigid case by means of a hose clamp 29 or by vulcanization.

The operation of the elastic sleeve 22 as non-return valve is as follows. In the idle state, i. e. when no compound is being injected through the bore hole sleeve, the exit opening of the sleeve has the shape of a narrow slot. When a compound is being injected through the bore hole sleeve, the exit opening of the elastic sleeve is expanded due to the elasticity of the sleeve, so that the exit opening gets a substantially round shape and obtains about the same flow area as the rigid case 10 of the bore hole sleeve, so that the non-return valve does not provide an obstruction neither for the plug 14, when the plug is pushed out of the rigid case, nor for the compound to be injected. When the injection is finished, i. e. when the rock crack is filled with the sealing and/or reinforcing compound, the pumping is discontinued. The pressure in the rigid case 10 and the elastic sleeve 22 is then substantially reduced. Due to the operation of the applied staples 23–26, the exit end of the sleeve endeavours to contract to the flattened shape. Due to the fact that the sleeve is still filled with compound under a certain pressure, the sleeve can contract itself only partly by its own effort. However, the pressure in the compound that has been injected into the rock crack and lies around the elastic sleeve is now higher than the pressure in the elastic sleeve and provides the flattening of the mouth of the sleeve required to prevent injected compound to be forced backwards from the rock crack into the rigid case and thus in opposite direction through the bore hole sleeve.

The very simple design of the non-return valve according to the invention makes the non-return valve very reliable in operation. Therefore, the pump hose can be disconnected from the bore hole sleeve immediately without any risk that the pressure in the cement grout injected into the bore hole is reduced, before the cement is completely burned. This makes the non-return valve very time-saving.

While only one embodiment of the non-return valve according to the invention has been shown and described above, it is obvious that many modifications and variations are possible within the scope of the invention. For example, it is possible to vary the number of staples and the position of the staples, so that the formed, diametrically positioned folds get another length and another width. Furthermore, it is possible to use other mechanical means than staples to provide the diametrical folds, for example U-shaped bars or loops that are clamped to the wall of the elastic sleeve without passing through the wall. If the elastic sleeve consists of a very soft material, the exit opening of the sleeve can also be contracted maintaining the round shape. The contracting means may then consist of for example one or more elastic or resilient rings arranged to surround the sleeve. The contracting means need not necessarily be positioned at the exit end of the elastic sleeve but can be positioned more towards the middle of the sleeve. The contracting ability of the sleeve can also be provided by the choice of a suitable elastic material and of a suitable shape of the sleeve, so that there is no need to provide the sleeve with special mechanical contracting means. For example, if the sleeve is provided with a conical or otherwise tapering free end, the free end of the sleeve will be expanded during the injection of compound and contracted, when the injection pressure ceases. The sleeve must not necessarily be adapted to reduce the flow area to zero, but a certain open area can be allowed in the sleeve in the contracted state of the sleeve, as the pressure outside the sleeve can provide the complete closure of the elastic sleeve, so that no injected compound can pass backwards through the non-return valve into the bore hole sleeve.

What we claim is:

1. A non-return valve for use with a bore hole sleeve for injecting a sealing and/or reinforcing compound into rock cracks and similar apertures, the bore hole sleeve including a rigid case (10), one end (10A) of which is provided with means for detachable connection to the case of a pump hose (12) for the compound to be injected, as well as an expandable device (15) which is mounted on the rigid case and which is expandable into engagement with the wall of the bore hole to secure the rigid case in the bore hole (21), said non-return valve comprising: an elastic sleeve (22) which is connected at the other end (10B) of the rigid case (10) in such a way that the rigid case (10) runs into the elastic sleeve (22); and contraction means for flattening the free end of the elastic sleeve when no compound is being injected so that already-injected compound cannot flow backwards into the rigid case (10), the contraction means including mechanical means adjacent the free end of the elastic sleeve for providing two projecting folds (27, 28) in the wall of the elastic sleeve, the projecting folds being diametrically positioned in relation to each other.

2. A non-return valve according to claim 1, wherein the contraction means are mechanical clamps (23-26).

3. A non-return valve according to claim 2, wherein the mechanical clamps consist of at least one staple (23,25) on either side of the elastic sleeve (22), each staple passing two times through the wall of the elastic sleeve (22).

4. A non-return valve according to claim 3, wherein each staple (23-26) has its longitudinal direction in parallel with the longitudinal axis of the elastic sleeve (22).

5. A bore hole sleeve for receiving flowable material that is forced through a conduit and for injecting the flowable material into a bore hole, comprising:

a rigid tubular case having first and second ends and having a lateral opening between the first and second ends;

means for connecting the first end of the case to the conduit;

an expandable first sleeve disposed around the case, the first sleeve having end regions which are sealingly connected to the case and having a central region which is not sealingly connected to the case, the lateral opening in the case being positioned to communicate with the central region of the first sleeve;

a one-way valve for the lateral opening in the case;

a flexible second sleeve having first and second ends;

means for connecting the first end of the second sleeve to the second end of the case, the second sleeve and case together defining a flow path along which the flowable material is transferred from the conduit to the bore hole;

first closure means for temporarily closing the flow path, as flowable material is being forced through the conduit, until the first sleeve has been expanded by flowable material into pressing contact with the wall of the bore hole to secure the case in the bore hole; and second closure means, cooperating with the second sleeve, for causing the second sleeve to collapse and close the flow path when flowable material is no longer being forced through the conduit, the second closure means including first elongated pinch means, disposed transverse to the second end of the second sleeve, for pinching the wall of the second sleeve together, and second elongated pinch means, disposed transverse to the second end of the second sleeve and spaced apart from the first pinch means, for pinching the wall of the second sleeve together.

6. The bore hole sleeve of claim 5, wherein the first and second pinch means pierce the second sleeve.

7. The bore hole sleeve of claim 6, wherein the first and second pinch means are disposed adjacent the second end of the second sleeve.

8. The bore hole sleeve of claim 7, wherein the first and second pinch means comprise staples.

9. The bore hole sleeve of claim 5, wherein the first closure means comprises a plug releasably closing the second end of the case.

10. The bore hole sleeve of claim 5, wherein the one-way valve comprises a flexible membrane disposed between the case and the first sleeve, the membrane being positioned to cover the lateral opening in the case.

11. The bore hole sleeve of claim 10, wherein the flexible membrane is a resilient band around the case.

12. The bore hole sleeve of claim 5, wherein the means for connecting the first end of the case to the conduit comprises selectively actuatable means for releasing the connection so that the conduit can be removed, leaving the bore hole sleeve in the bore.

13. The bore hole sleeve of claim 12, wherein the selectively actuatable means comprises screw threads.

* * * * *